US005311685A

United States Patent [19]

Wyant

[11] Patent Number: 5,311,685

[45] Date of Patent: May 17, 1994

[54] HANGING FILE FOLDER ASSEMBLY

[75] Inventor: Jon R. Wyant, Spring Valley, Ohio

[73] Assignee: The Mead Corporation, Dayton, Ohio

[21] Appl. No.: 851,340

[22] Filed: Mar. 16, 1992

Related U.S. Application Data

[63] Continuation-in-part of Ser. No. 576,534, Aug. 31, 1990, abandoned.

[51] Int. Cl.[5] ..... B42F 21/06

[52] U.S. Cl. ..... 40/359; 40/641

[58] Field of Search ..... 40/359, 360, 641; 101/369; 312/183; 283/36; 229/1.5 R, 68 R

[56] References Cited

U.S. PATENT DOCUMENTS

| | | | |
|---|---|---|---|
| 2,538,361 | 1/1951 | Fürrer | 40/359 |
| 2,632,449 | 3/1953 | Lowings | 229/1.5 R X |
| 2,679,846 | 6/1954 | Addison | 40/360 |
| 2,874,699 | 2/1959 | Dunleavy | 40/359 |
| 3,037,510 | 6/1962 | Saymon | 40/360 |
| 3,039,470 | 6/1962 | Podner | 40/641 X |
| 3,164,917 | 1/1965 | Harper | 40/641 X |
| 3,288,144 | 11/1966 | Hyams | 40/359 X |
| 3,459,361 | 8/1969 | Matton | 40/359 |
| 4,053,057 | 10/1977 | Snowden | 40/359 X |
| 4,209,925 | 7/1980 | Brügmann | 40/359 |

FOREIGN PATENT DOCUMENTS

| | | | |
|---|---|---|---|
| 0619158 | 10/1930 | France | 40/360 |
| 0462777 | 11/1968 | Switzerland | 40/359 |
| 0310197 | 4/1929 | United Kingdom | 40/359 |
| 0444054 | 3/1936 | United Kingdom | 40/359 |

*Primary Examiner*—Kenneth J. Dorner
*Assistant Examiner*—Milton Nelson, Jr.
*Attorney, Agent, or Firm*—Biebel & French

[57] ABSTRACT

A hanging file folder assembly includes a file folder having a pair of upwardly extending walls joined along a lower fold line and a mounting flap folded downwardly from a top edge of one wall. The mounting flap is secured to its associated wall along a continuously extending medial joinder line to define an enclosed guide passage for insertion of a suspension bar and an open gripping channel for entry by a lower retaining plate of an index tab holder. An index tab holder for use with the file folder is provided with a lower retaining plate for insertion into the gripping channel and an upper retaining plate for engaging the file folder wall above and opposite the gripping channel.

14 Claims, 8 Drawing Sheets

6
110
137
146
139
142
150
6
139
138

144
142
137
146
129
150
136
138

110
317
137
139
150
314
300
138
139

HANGING FILE FOLDER ASSEMBLY

CROSS-REFERENCE TO RELATED APPLICATION

This application is a continuation-in-part of Ser. No. 07/576,534, filed Aug. 31, 1990 and now abandoned.

BACKGROUND OF THE INVENTION

The subject invention relates to a hanging file folder assembly comprising a pair of suspension bars, at least one of which is slidably received. It relates furthermore to a novel file folder and a novel index tab holder adapted for use in such an assembly.

Hanging file folders are commonly used for separating different categories of documents stored in cabinetry such as file cabinets, credenzas, and the like. Such cabinetry typically includes storage drawers provided with support rails mounted along both sides thereof and extending longitudinally in the direction of drawer movement. A hanging file for such an application may be fashioned from a rectangular paperboard sheet which is centrally folded to define front and rear walls for the folder. The marginal sheet portions remote from the central fold line are folded over and secured to their parent walls so as to define front and rear guide passages. Suspension bars are then inserted into these passages. The suspension bars are of sufficient length to span the distance between the support rails. When in use the suspension bars are hooked over the support rails, so that the file folder is suspended therefrom.

Hanging file folder assemblies usually include index tabs are inserted into index tab holders mounted on at least some of the file folders for displaying index tabs which identify the subject matter of the documents filed therein. However, hanging file folders come in a number of different designs, and it is desirable to provide index tab holders which are able to accommodate a range of design variations.

Hanging file folders of the above described type frequently have a plurality of spaced slits along the length of at least one guide passage. These slits afford entry points for mounting ears projecting sidewardly from opposite of such mounting is shown in Snowden, U.S. Pat. No. 4,053,057. It is apparent that this mounting technique affords mounting at only a relatively few predesignated locations. Moreover, the index tab holders must have a length equal to the distance between adjacent slits or an integral number of such distances.

It is an object of this invention to provide a hanging file folder assembly having a freely moveable index tab holder.

Another object of the invention is to provide a hanging file folder having improved means for mounting an index tab holder along a suspension bar guide passage.

It is another object of the invention to provide an index tab holder which may be mounted at any desired position along a guide passage of a hanging file folder.

It is a further object of the invention to provide an index tab holder which may be mounted along a guide passage of a hanging file folder irrespective of index tab holder length.

Other objects and advantages of the invention will be apparent from the following description, the accompanying drawings and the appended claims.

SUMMARY OF THE INVENTION

The objects of the invention are achieved by providing a hanging file folder having a mounting flap which is folded downwardly from the top of a folder wall and thereafter secured to the folder wall along a medially extending joinder line so as to define an enclosed guide passage for a suspension bar and an open gripping channel for an index tab holder. The index tab holder is constructed from transparent plastic material and is shaped to define a lower retaining plate, a support plate, a face plate, a rear plate and an upper retaining plate.

The lower retaining plate of the index tab holder is configured for reaching upwardly into the gripping channel of the file folder and extending downwardly therefrom to a forwardly directed lower bend line. The support plate is joined to the lower retaining plate along the lower bend line and extends upwardly to a middle bend line. The support plate is oriented parallel to the lower retaining plate and is positioned forwardly thereof, so that the lower retaining plate and the support plate cooperatively may capture the free lower end of the mounting flap.

The face plate and the rear plate are supported by the support plate at the middle bend line and extend angularly upward in parallel relationship to define a receiving slot for an index tab. The upper retaining plate extends downwardly from the rear plate in spaced parallel relation to the support plate for hooking rearwardly and downwardly around the upper edge of the file folder. Abutment means are connected to the upper retaining plate for limiting downward movement of the index tab holder by engaging the upper edge of the file folder. It is a feature of the invention that the forwardly facing surface of the upper retaining plate is parallel to and rearward of the forwardly facing surface of the lower retaining plate so as to accommodate the thickness of the file folder.

Since the index tab holder is attached to the file folder along continuously extending horizontal surfaces, it may be slid therealong to any desired mounting location. This allows the user to arrange the index tabs of consecutive file folders at a variety of intervals, depending on the number of index tabs required. Moreover, as the length of the index tab holder is not restricted in any way, it may be provided in a variety of convenient sizes or cut to a desired size by the end user.

FIG. 1 a perspective view of the index tab holder of the invention;

DETAILED DESCRIPTION OF THE PREFERRED EMBODIMENT

Figure 3:
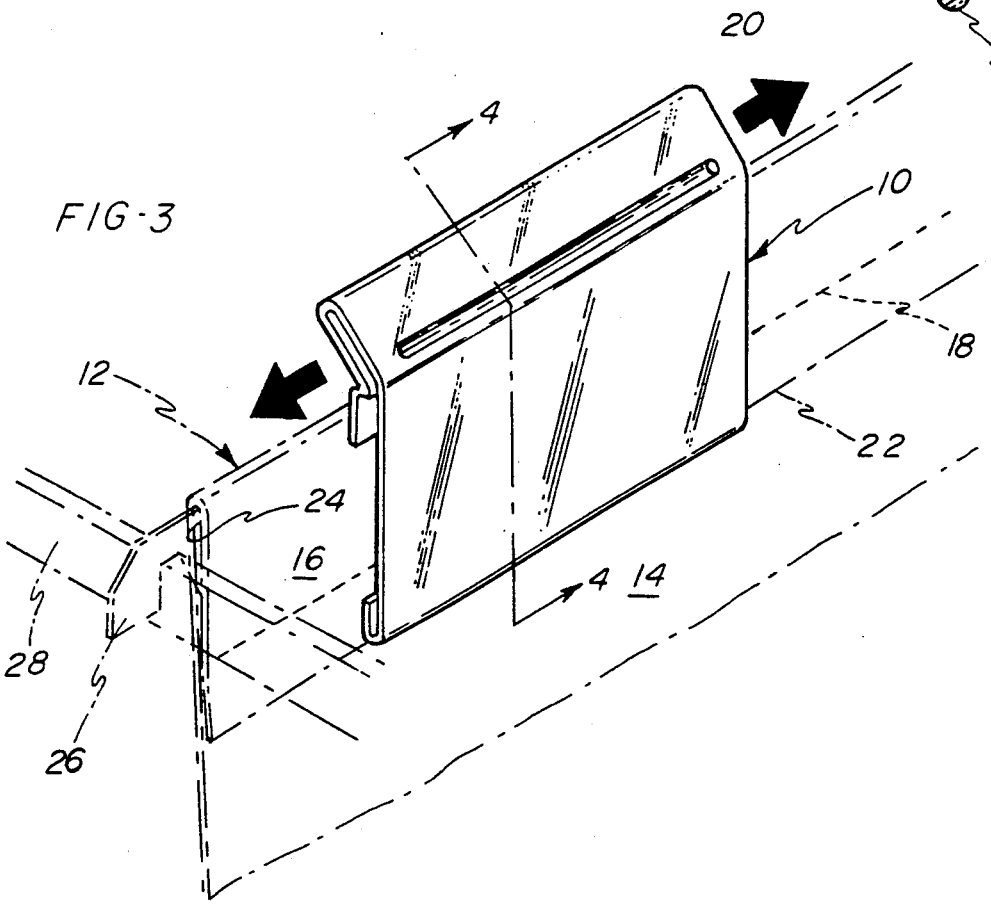
FIG. 3 is a perspective view of the index tab holder attached a hanging file folder.
Figure 4:
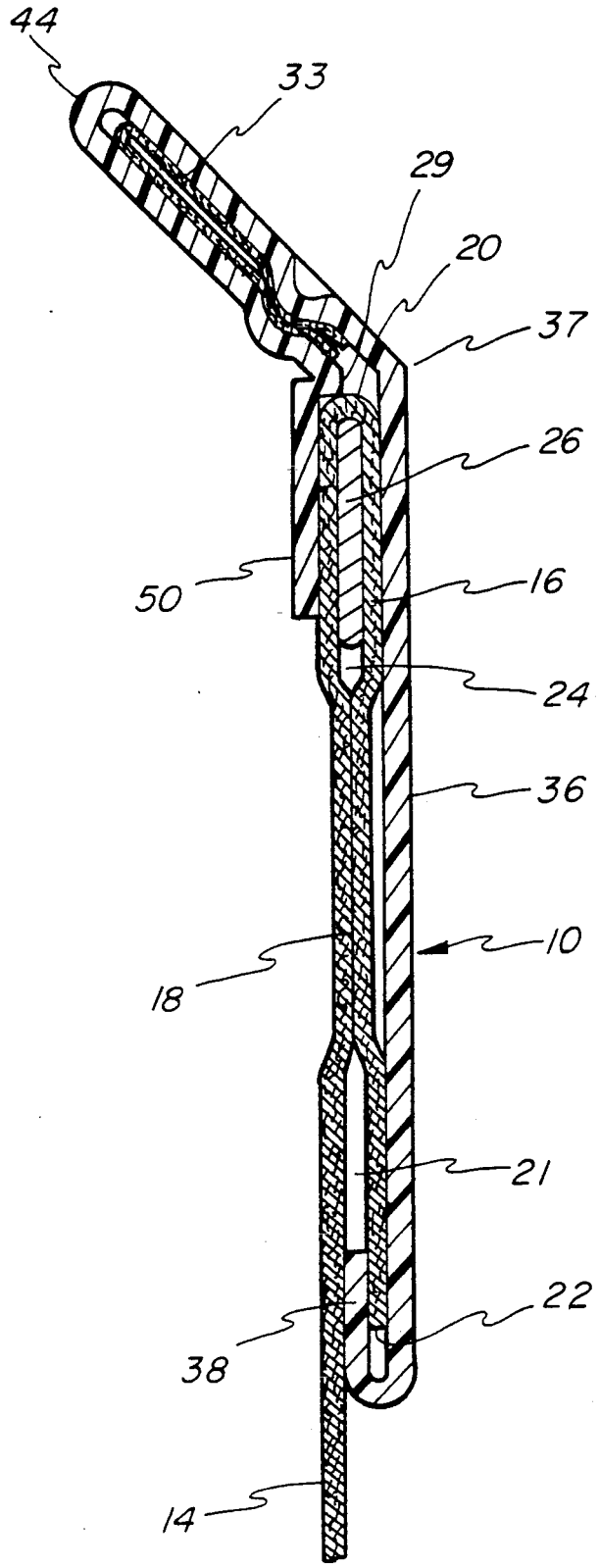
FIG. 4 is a cross-sectional view taken along lines 4—4 of FIG. 3.
Figure 5:
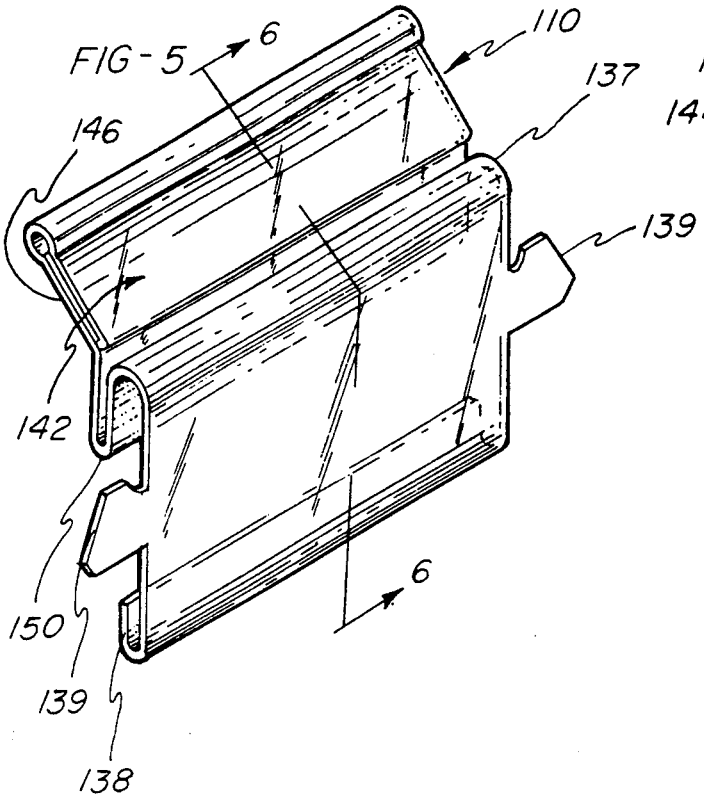
FIG. 5 is a perspective view of an alternative embodiment invention.
Figure 6:
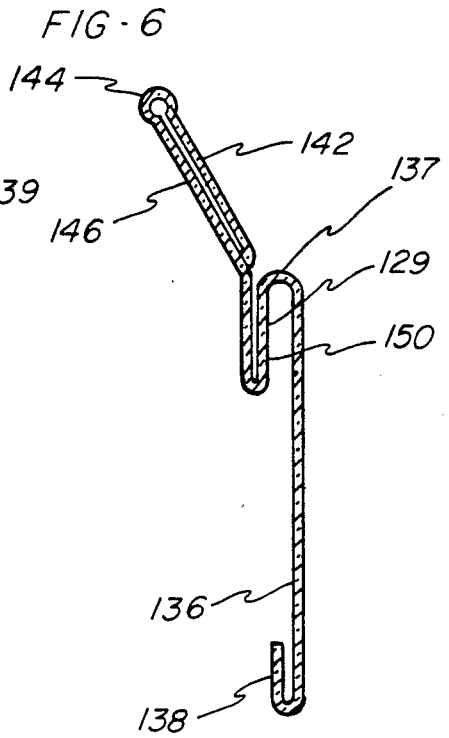
FIG. 6 is a cross-sectional view taken along lines 6—6 of FIG. 5.

With reference first to FIGS. 3 and 4, an index tab 33 is retained by an index tab holder 10 mounted upon a rear wall 14 of a hanging file folder 12. File folder 12 has a mounting flap 16 foldably attached to the upper end of the wall 14 and bent forwardly and downwardly therefrom. Mounting flap 16 is secured to wall 14 along a medial joinder line 18, so that the lower edge 22 of mounting flap 16 is freely accessible. A gripping channel 21 is thereby defined between mounting flap 16 and file folder wall 14 in a region below the joinder line 18. The attachment of mounting flap 16 to the wall 14 along medial joinder 18 also creates a guide passage 24 for receiving a suspension bar 26. As illustrated in FIG. 3, suspension bar 26 is configured for resting supportingly across a pair of longitudinally extending rails 28,28 (only one of which is illustrated) in the manner well-known in the prior art.

Medial joinder line 18 may comprise a narrow strip of adhesive extending substantially along the entire length of file folder 12. Stitching or other attachment means may be provided, so long as medial joinder line 18 is substantially continuous to afford a gripping channel 21 which runs the full length of the file folder.

Figure 1:
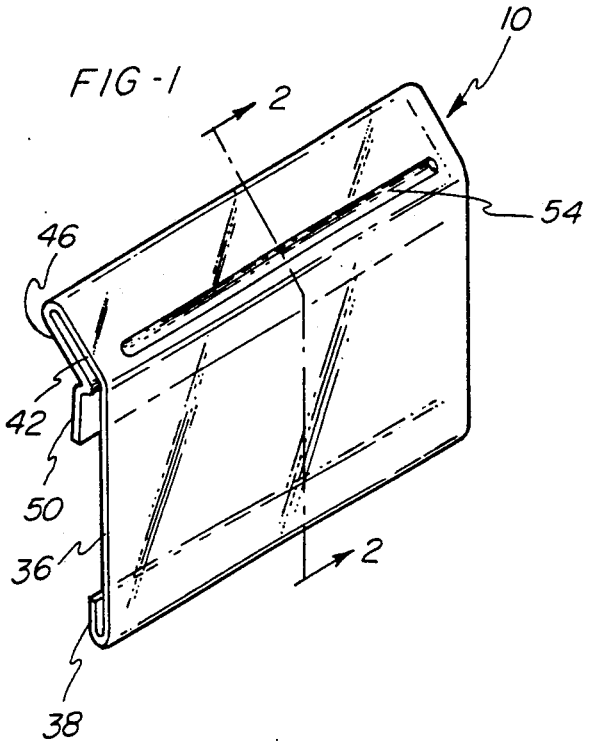
Figure 2:
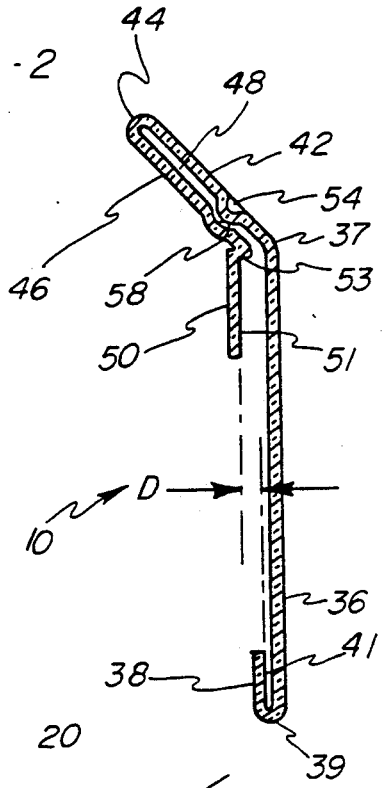
FIG. 2 is a cross-sectional view taken along lines 2—2 of FIG. 1.

As illustrated in FIGS. 1 and 2, index tab holder 10 comprises a lower retaining plate 38 for reaching upwardly inside gripping channel 21. Lower retaining plate 38 extends downwardly to a forwardly directed lower bend line 39. A support plate 36 extends upwardly from lower bend line 39 in spaced parallel relation to lower retaining plate 38. The bending direction of lower bend line 39 positions support plate 36 forwardly of lower retaining plate 38.

Support plate 36 extends upwardly to a middle bend line 37. A face plate 42 extends upwardly and rearwardly from middle bend line 37. A receiving slot 48 for an index tab 33 is defined between face plate 42 and a rear plate 46. Rear plate 46 is joined to face plate 42 along a rearwardly directed upper bend line 44 and extends in a forward and downward direction parallel to face plate 42. Face plate 42 and rear plate 46 may be provided with horizontally extending depressions 54,58 to provide an interference fit for index tab 33. This assures secure retention of the index tab.

Rear plate 46, extends downwardly to a rear bend line 53 where it joins upper retaining plate 50. Upper retaining plate 50 extends in a downward direction parallel to support plate 36 and to lower retaining pate 38. Upper retaining plate 50 is displaced rearwardly of lower retaining plate 38 by a displacement distance which accommodates the structure of the file folder. The displacement distance "D" may be measured between the planes of the forward faces 41,51 of retaining plates 38,50 respectively. A forwardly extending abutment 29 is positioned at the upper extent of upper retaining plate 50 to prevent excessive downward movement of index tab holder 10. Consequently, lower retaining plate 38 is maintained inside gripping channel 21.

Figure 10:
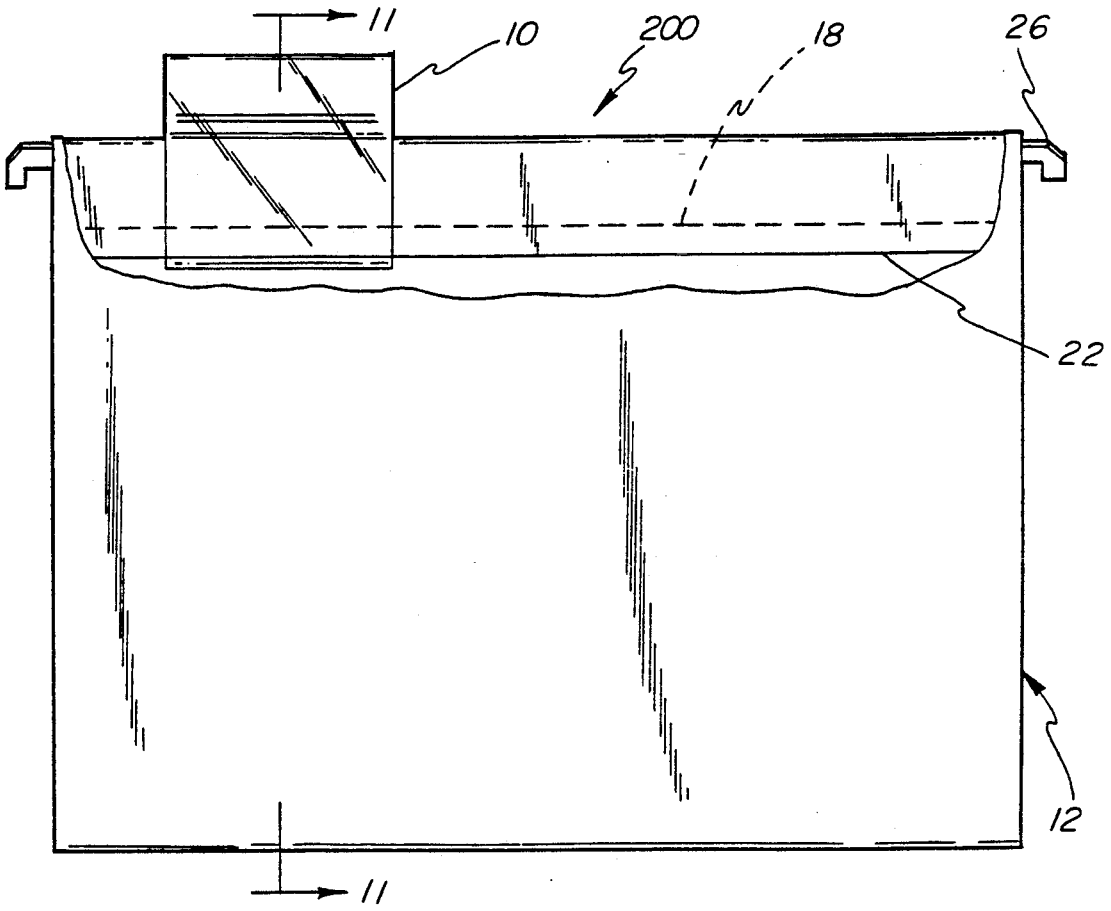
FIG. 10 is a partially cut-away front elevation view of a hanging file folder assembly.
Figure 11:
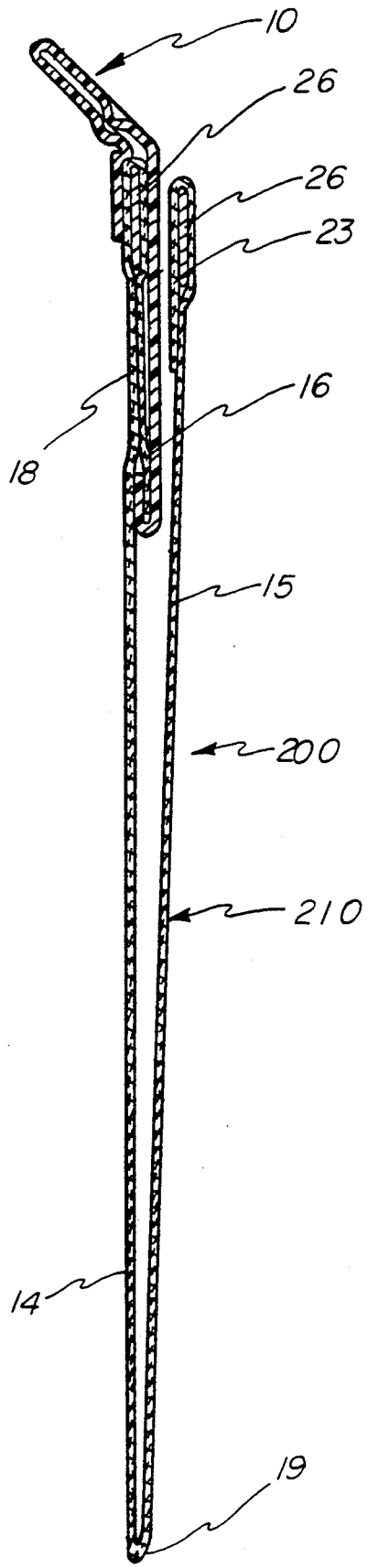
FIG. 11 is a cross-sectional view taken along lines 11—11 of FIG. 10.

The mounting of index tab holder 10 on rear wall 14 of a file folder 12 is best illustrated in FIGS. 4, 10 and 11. Index tab holder 10 is slid onto the wall 14 at either end of file folder 12 after being positioned in such a manner that lower retaining plate 38 slips into gripping channel 21 while abutment 29 engages upper edge 20 and upper retaining plate 50 fits against the rear surface of the wall. It will be observed that upper retaining plate 50 must be set back from support plate 36 sufficiently far to accommodate the combined thicknesses of mounting flap 16, suspension bar 26 and rear wall 14.

A completed file folder assembly 200 comprises a file folder 12, an index tab holder 10 and a pair of suspension bars 26,26. File folder 12 in turn comprises the rear wall 14 joined to a front wall 15 along a fold line 19 and the mounting flap 16 which is folded downwardly and forwardly from the top of rear wall 14 as described above. Medial joinder line 18 maintains mounting flap 16 securely in contact with the front face of rear wall 14 across substantially the entire length of the file folder while concomitantly defining guide passage 24 and gripping channel 40. Thus index tab holder 10 may be slid to any desired position along the length of the file folder. A front flap 23 is secured to front wall 15 in the customary manner to define a guide channel for the front suspension bar 26. In an alternative embodiment (not illustrated) the front suspension bar 26 may be replaced by a permanently fixed suspension bar of the type known in the prior art.

Figure 7:
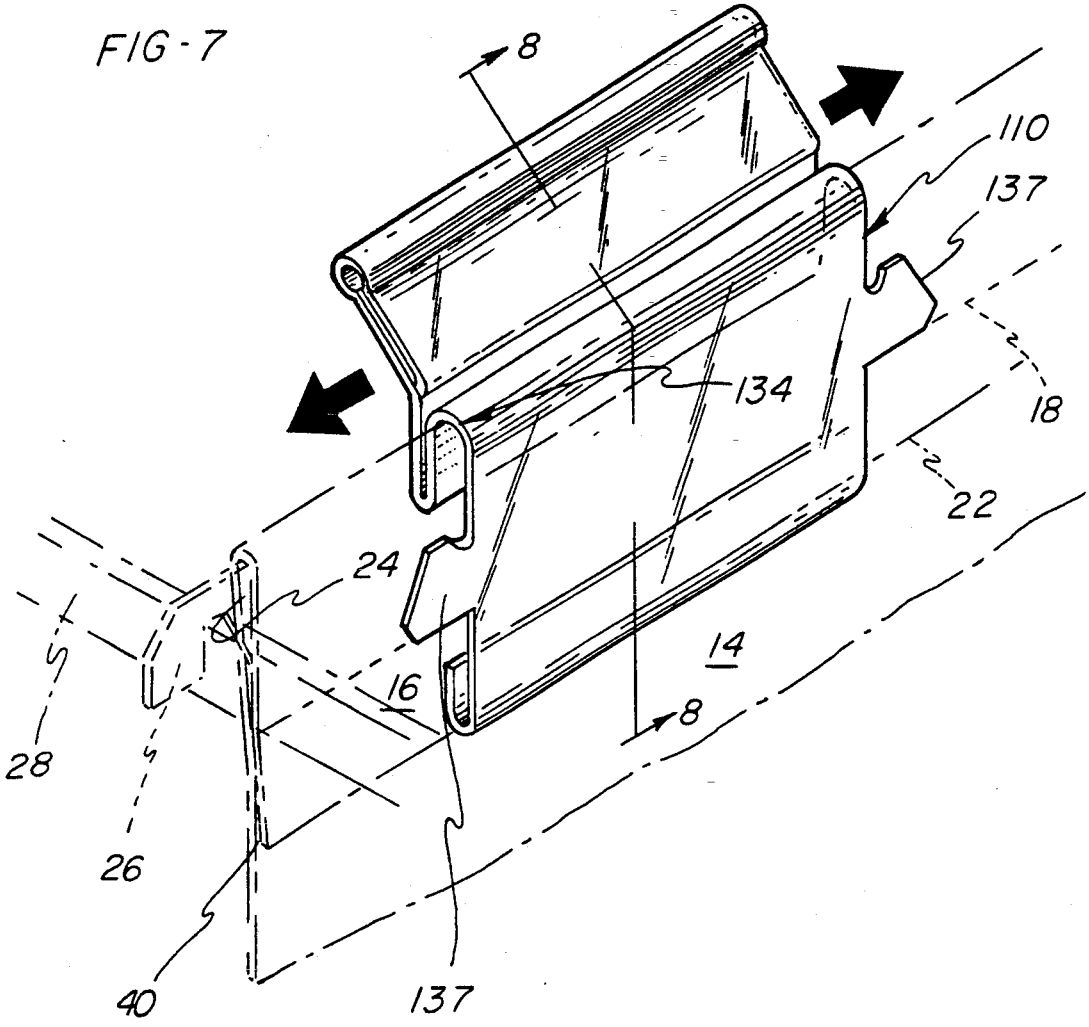
FIG. 7 is a perspective view of the index tab holder of FIG. 5 attached to a hanging file folder of a type provided with a channel.
Figure 8:
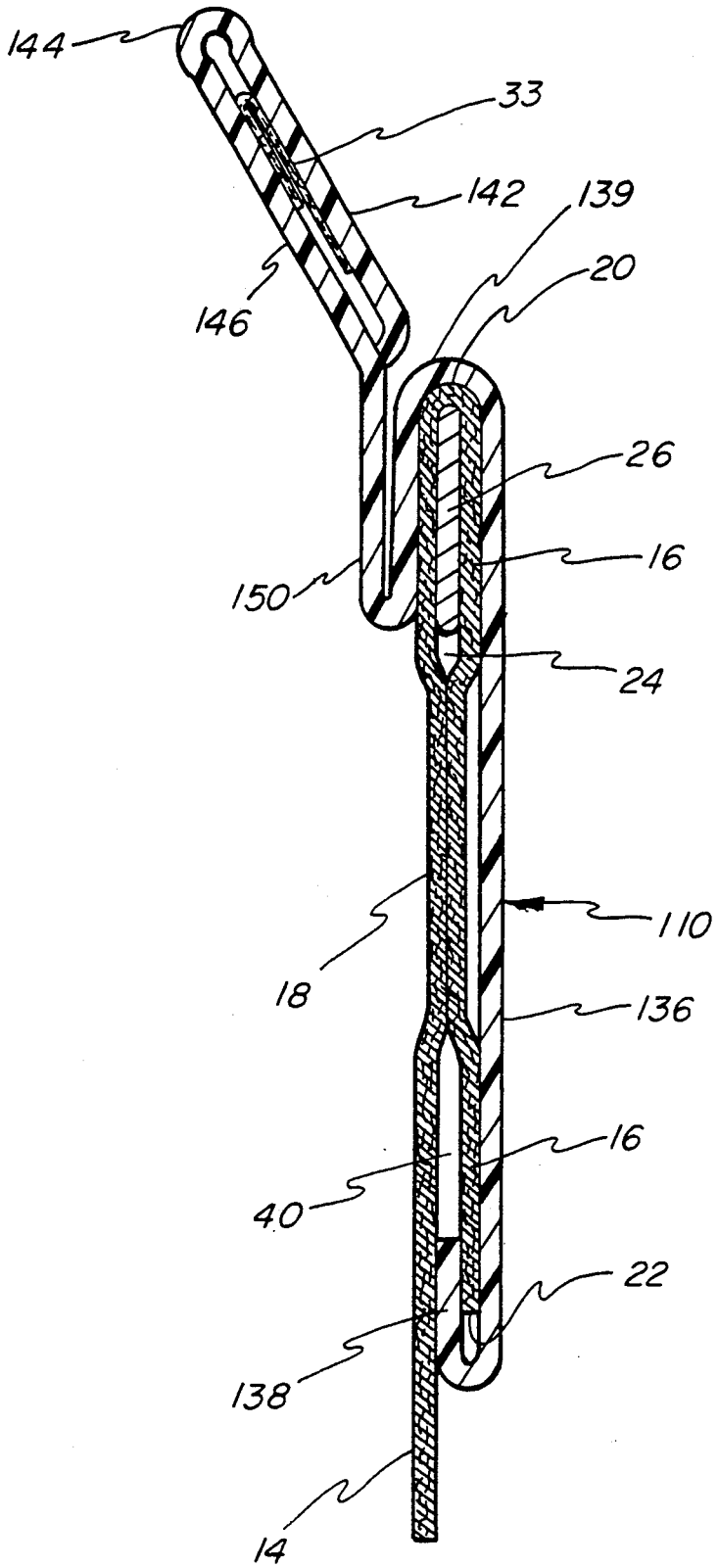
FIG. 8 is a cross-sectional view taken along lines 8—8 of FIG. 7.

An index tab holder 110 in an alternative embodiment is illustrated in FIGS. 5-9. In that embodiment the index tab holder comprises a lower retaining plate 138, a support plate 136, a face plate 142, a rear plate 146, abutment means 129, and an upper retaining plate 150, all having functions as described above for their counterpart elements in index tab holder 10 of FIGS. 1-4. Moreover, the physical connection between lower retaining plate 138 and support plate 136 is the same as above described for the previous embodiment. However, as best illustrated in FIG. 8, abutment means 129 comprises a plate which joins retention plate 150 to a middle bend line 137. Accordingly, retaining plate 150 supports rear plate 146, while rear plate 146 supports face plate 142 at upper bend line 149.

Figure 9:
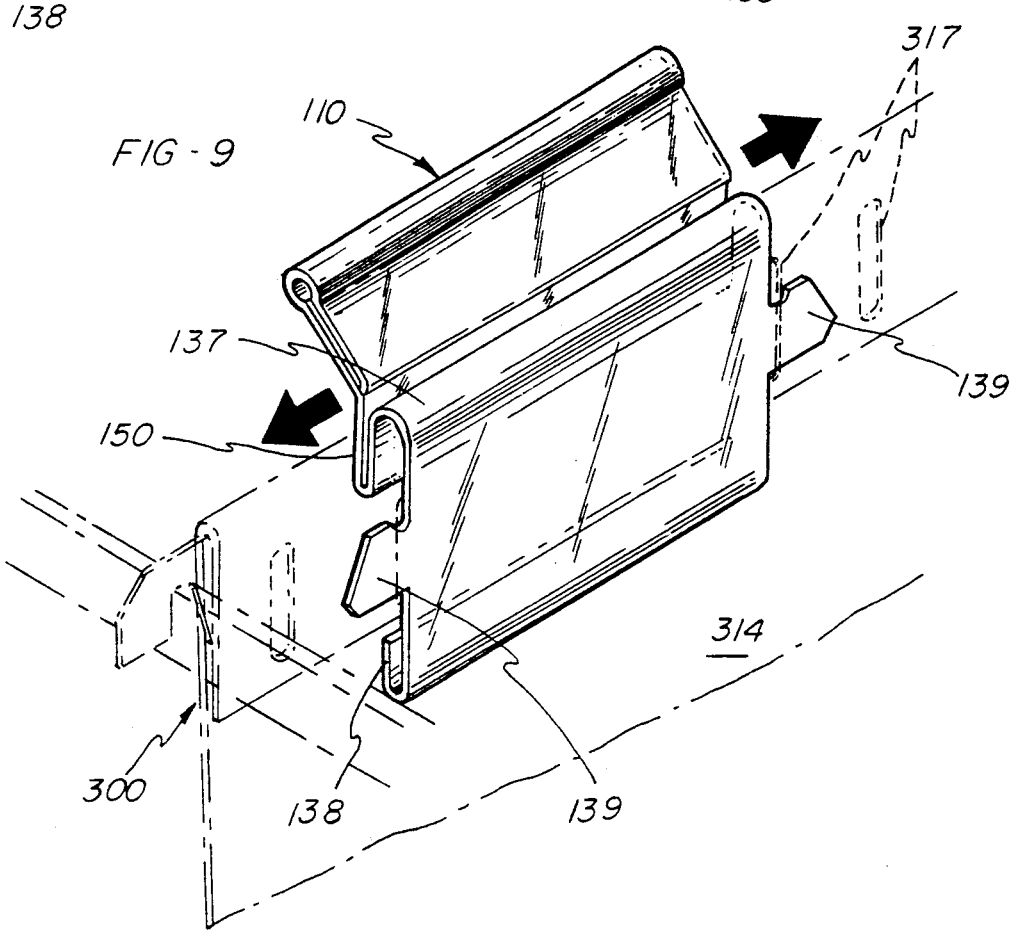
FIG. 9 is a perspective view of the index tab holder of FIG. 5 attached to a hanging file folder of a type provided with regularly spaced mounting slits.

The alternative embodiment further may be provided with a pair of sidewardly extending ears 139,139. This enables index tab holder 110 to be mounted on a rear wall 314 of a conventional file folder 300 provided with a series of spaced slots 317, as illustrated in FIG. 9. When so mounted on a file folder of that particular type, lower retaining plate 138 is nonfunctional. For such an arrangement, ears 139,139 of index tab holder 110 are inserted into a pair of spaced slots 317 while upper retaining plate 150 fits over the top of the file folder and engages the rear face of the rear wall 314.

Index tab holder 110 also may be used with the file folder of the present invention, as illustrated in FIG. 7. In that case the ears 139,139 are nonfunctional, while lower retaining plate 138 fits inside gripping channel 40. Accordingly, index tab holder 110 has utility with file folders of the present invention as well as with file folders according to the prior art.

Figure 12:
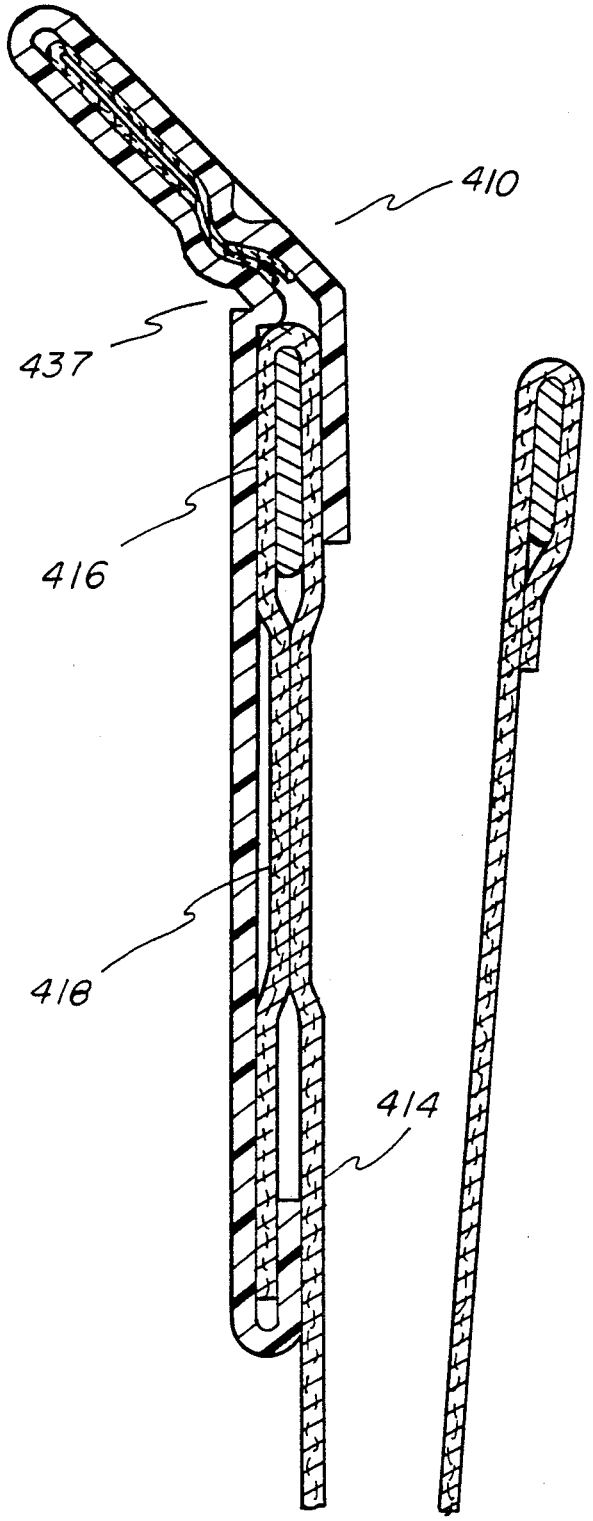
FIG. 12 is a side elevation view of a second alternative embodiment of the invention.

In another alternative embodiment of the invention, mounting flap 416 may be medially joined to the rear surface of wall 414, as illustrated in FIG. 12. For that embodiment index tab holder 410 has a configuration similar to index tab holder 10, except that the middle bend line 437 is bent in the same direction as mounting flap 416.

In the preferred embodiment of the invention, the index tab holder 10 is cut from a unitary sheet of transparent plastic material, such as polyethylene, and is heated and formed into the configuration shown in FIG. 1. Alternatively, however, index tab holders according to the present invention may manufactured by an extrusion process, be extruded into elongate strips, in which case the projections 54 and 58 extend the full width of the index tab holder. In either case, since the length of the index tab holder 10 is not dependent on the design of the file folders, the index tab holders 10 can be made in a variety of lengths or may be cut to any desired length by the user.

While the forms of manufacture herein described constitute preferred embodiments of this invention, it is to be understood that the invention is not limited to these precise forms of manufacture, that the forward and rearward directions may be reversed, and that changes may be made therein without departing from the scope of the invention which is defined in the appended claims.

What is claimed is:

1. A hanging file folder assembly, comprising:

a file folder comprising a pair of walls joined along a lower fold line, and a mounting flap folded downwardly from an upper edge of one of said walls and medially joined to a surface of said one wall along a substantially continuous, full length medial joinder line, thereby defining an open gripping channel below said joinder line and an enclosed guide passage thereabove;

a first suspension bar captured in said guide passage for hanging said file folder;

an index tab holder comprising a lower retaining plate inserted into said gripping channel, a support plate secured to said lower retaining plate and extending upwardly outside said gripping channel, an upper retaining plate supported by said support plate and positioned against the upper edge of said one wall opposite said support plate for retaining said one wall, said first suspension bar and said mounting flap therebetween, and means supported by said support plate for defining an index tab receiving slot; and a second suspension bar secured to edge of the other of said walls.

2. A hanging file folder assembly according to claim 1 wherein said mounting flap is folded against a forwardly facing surface of said one wall.

3. A hanging file folder assembly according to claim 1 wherein said means defining an index tab receiving slot comprises an upwardly extending face plate joined to said support plate and a downwardly extending rear plate connected between said face plate and said upper retaining plate.

4. A hanging file folder comprising:

a pair of walls joined along a lower fold line;

a mounting flap folded downwardly from an upper edge of one of said walls and medially joined to a surface of said one wall along a substantially continuous, full length medial joinder line, thereby defining an open gripping channel below said joinder line and an enclosed guide passage thereabove; and means for grasping a suspension bar at a top edge of the other of said walls.

5. A hanging file folder according to claim 4 wherein said mounting flap is folded against a forwardly facing surface of said one wall.

6. A single piece index tab holder for alternative mounting on a hanging folder having spaced vertical slits along an upper edge thereof or on a hanging folder having a horizontally extending gripping channel defined between a wall of said hanging folder and a free lower edge of a mounting flap extending downwardly from an upper edge of said wall; said index tab holder comprising:

a downwardly extending lower retaining plate which is downwardly terminated at a forwardly directed lower bend line for insertion into said gripping channel;

a support plate which is positioned in forwardly spaced parallel relation to said lower retaining plate, is upwardly bounded by a middle bend line and is downwardly joined to said lower retaining plate at said lower bend line;

a face plate supported by said support plate at said middle bend line and angled upwardly therefrom;

a rear plate jointed to said face plate and angled downwardly in parallel relation to said face plate so as to define an index tab slot therebetween;

an upper retaining plate supported by said support plate at said middle bend line and extending downwardly in parallel relation to said support plate; and a pair of mounting ears projecting outwardly from opposite sides of said support plate for insertion into a pair of said vertical slits.

7. For use with a hanging file folder comprising a wall which is upwardly bounded by a fold line, a mounting flap folded downwardly from said fold line and medially jointed to said wall along a medial joinder line so as to define an enclosed guide passage immediately below said fold line and an open gripping channel immediately below aid guide passage; an index tab holder of single-piece transparent plastic construction comprising:

a lower retaining plate extending downwardly to a forwardly directed lower bend line;

a support plate joined to said lower retaining plate forwardly of said lower bend line and extending upwardly therefrom to a middle bend line;

a face plate supported by said support plate and angled upwardly from said middle bend line;

a rear plate supported by said support plate and angled upwardly from said middle bend line;

a rear plate supported by said support plate and angled upwardly from said middle bend line;

a rear plate supported by said support plate in parallel relation to said face plate so as to define an index tab slot therebetween;

an upper retaining plate supported by said support plate in a position rearwardly of and parallel to said lower retaining plate; and abutment means projecting between said upper retaining plate and said support plate for engaging said fold line while said lower retaining plate extends engagingly into said gripping channel.

8. An index tab holder according to claim 7 further comprising a pair of mounting ears projecting laterally away from opposite vertical edges of said support plate.

9. An index tab holder according to claim 7 wherein said face plate is joined to said support plate at said middle bend line.

10. An index tab holder according to claim 9 wherein said face plate is upwardly bounded by an upper bend line and said rear plate is joined to said face plate at said upper bend line.

11. An index tab holder according to claim 10 wherein said rear plate is downwardly bounded by a rear bend line and said upper retaining plate is joined to said rear plate at said rear bend line.

12. An index tab holder according to claim 11 wherein said abutment means are joined to said upper retaining plate at said rear bend line.

13. An index tab holder according to claim 12 wherein said face plate and said rear plate are provided with complementary depressions for gripping an index tab positioned in said index tab slot.

14. An index tab holder according to claim 12 wherein said face plate extends upwardly and rearwardly from said middle bend line.

* * * * *

UNITED STATES PATENT AND TRADEMARK OFFICE

CERTIFICATE OF CORRECTION

PATENT NO. : 5,311,685

DATED : May 17, 1994

INVENTOR(S) : Jon R. Wyant

It is certified that error appears in the above-indentified patent and that said Letters Patent is hereby corrected as shown below:

Column 5, line 46, after "to" insert --an upper--.

Column 6, line 36, "jointed" should be --joined--;
line 39, "aid" should be --said--.

Column 6, delete lines 49-52.

Signed and Sealed this

Seventh Day of February, 1995

*Attest:*

*Attesting Officer*

BRUCE LEHMAN

*Commissioner of Patents and Trademarks*